US009550195B1

(12) United States Patent
Cao et al.

(10) Patent No.: US 9,550,195 B1
(45) Date of Patent: Jan. 24, 2017

(54) SHOWER HEAD

(71) Applicants: XIAMEN SOLEX HIGH-TECH INDUSTRIES CO., LTD., Xiamen, Fujian (CN); Huasong Zhou, Xiamen, Fujian (CN)

(72) Inventors: Yongbin Cao, Fujian (CN); Canbin Lai, Fujian (CN); Tao Cai, Fujian (CN); Huasong Zhou, Fujian (CN)

(73) Assignees: XIAMEN SOLEX HIGH-TECH INDUSTRIES CO., LTD., Xiamen (CN); Huasong Zhou, Xiamen (CN)

( * ) Notice: Subject to any disclaimer, the term of this patent is extended or adjusted under 35 U.S.C. 154(b) by 0 days.

(21) Appl. No.: 14/855,969

(22) Filed: Sep. 16, 2015

(51) Int. Cl.
*B05B 1/10* (2006.01)
*B05B 1/18* (2006.01)
*B05B 1/30* (2006.01)

(52) U.S. Cl.
CPC *B05B 1/185* (2013.01); *B05B 1/30* (2013.01)

(58) Field of Classification Search
CPC ..... B05B 1/185; B05B 1/30; B05B 1/3033; B05B 1/3026; B05B 1/16; B05B 1/1627; B05B 1/1663
USPC ..... 239/436–449
See application file for complete search history.

(56) References Cited

U.S. PATENT DOCUMENTS 2,538,211 A * 1/1951 Prout ..... B05B 1/1627 239/446
5,145,114 A * 9/1992 Monch ..... B05B 1/1618 239/126
6,145,757 A * 11/2000 Knapp ..... B05B 1/1609 239/443
6,290,147 B1 * 9/2001 Bertrand ..... B05B 1/1618 239/444
6,357,675 B1 * 3/2002 Schorn ..... B05B 7/0425 239/311
6,691,933 B1 * 2/2004 Bosio ..... B05B 15/0291 239/106
7,341,239 B2 * 3/2008 Hodel ..... F16K 31/52416 137/872
7,909,296 B2 * 3/2011 Moran-Grover ..... A47F 5/0846 211/103
2006/0016912 A1 * 1/2006 Nobili ..... B05B 1/1618 239/525
2012/0012676 A1 * 1/2012 Hu ..... B05B 1/1663 239/525

* cited by examiner

*Primary Examiner* — Arthur O Hall
*Assistant Examiner* — Viet Le
(74) *Attorney, Agent, or Firm* — Rabin & Berdo, P.C.

(57) ABSTRACT

A shower head includes a fixation portion and a switch mechanism. The fixation portion has two diversion waterways that connect to an inlet waterway. The switch mechanism rotates the two diversion waterways. The first diversion waterway has a mutation cavity connected to a diversion hole. The mutation cavity has a flow straightener that water from the diversion hole collides in the flow straightener. The second diversion waterway has a first section and a second section with a larger outlet. A suction hole is disposed between the mutation cavity and the second section. When water flows out of the first diversion waterway, air enters the mutation cavity from the second diversion waterway through the suction hole, bubble water flows out of the first diversion waterway; when water flows out of the second diversion waterway, air enters the second section from the first diversion waterway through the suction hole.

10 Claims, 5 Drawing Sheets

SHOWER HEAD

FILED OF THE INVENTION

The present invention relates to a shower head.

BACKGROUND OF THE INVENTION

Existing shower head comprises a fixation portion and a switch mechanism, the fixation portion is disposed with an inlet waterway, a first diversion waterway and a second diversion waterway, the first diversion waterway and the second diversion waterway are capable of connect to the inlet waterway, the switch mechanism is assembled to the fixation portion to switch the first diversion waterway and the second diversion waterway to connect to the inlet waterway. The first diversion waterway is disposed with a bubble making device, the bubble making device is disposed with an air inlet hole that connects the inner and outer of the fixation portion, an inlet airway is further disposed, so that the structure is complicated that makes it occupy large space.

SUMMARY OF THE INVENTION

The present invention provides a shower head that overcomes the disadvantages of the shower head in existing known technology.

The technical proposal of the present invention to solve the technical problem is that: A shower head, comprising a fixation portion (10) and a switch mechanism (20), the fixation portion (10) is disposed with an inlet waterway (11), a first diversion waterway (30) and a second diversion waterway (40), the first diversion waterway (30) and the second diversion waterway (40) can be connected to the inlet waterway (11), the switch mechanism (20) is assembled to the fixation portion (10) to switch the first diversion waterway (30) and the second diversion waterway (40) to be connected to the inlet waterway (11); wherein the first diversion waterway (30) comprises at least a diversion hole (31) and a mutation cavity (32) connected to the diversion hole (31), a flow straightener (33) is disposed in the mutation cavity (32) that water from the diversion hole (31) collides in the flow straightener (33); the second diversion waterway (40) comprises a first section (41) and a second section (42) connected to the first section (41), the outlet of the first section (41) is smaller than that of the second section (42); a suction hole (50) is disposed between the mutation cavity (32) and the second section (42).

In another preferred embodiment, the outlet openings of the first waterway (30) and the second waterway (40) are disposed at one end of the fixation portion (10), the second section (42) is annular shaped and surrounding the mutation cavity (32).

In another preferred embodiment, the first diversion waterway (30) and the second diversion waterway (40) are respectively disposed with a first diversion port (34) and a second diversion port (43); the switch mechanism (20) comprises a switch shaft (21), a switch sealing ring (22) sleeved on the switch shaft (21) and a dial button (23), the switch shaft (21) is disposed in the fixation portion (10) in sliding way, one end of the dial button (23) is inserted to the fixation portion from the outer side of the fixation portion (10) and then fixedly connected to the switch shaft (21); the switch shaft (21) can drive the switch sealing ring (22) to slide to close the first diversion port (34) and the second diversion port (43) alternatively, the dial button (23) can slide up and down along the fixation portion (10) to drive the switch shaft (21) to slide up and down.

In another preferred embodiment, the first diversion port (34) and the second diversion port (43) are arranged vertically symmetrically along the fixation portion (10), the switch sealing ring (22) is disposed between the first diversion port (43) and the second diversion port (34).

In another preferred embodiment, the switch mechanism further comprises an elastic body (24) between the switch shaft (21) and the fixation portion (10).

In another preferred embodiment, the fixation portion (10) comprises a main body (13) with a central hole (12), a valve body (14) and a cover (15);

the valve body (14) is disposed with an inlet section (141) and a cylindrical portion (142) with the opening facing down, the inlet waterway (11) is disposed in the inlet section (141), the cylindrical portion (142) is disposed with a groove (143) with the opening facing down, an upper diversion body (16) is fixedly disposed in the groove (143) in sealing way, a water diversion cavity (144) connected to the inlet waterway (11) is formed between the upper diversion body (16) and the groove bottom of the groove (143); the upper diversion body (16) is disposed with a first water diversion port (34) running through the upper diversion body (16) up and down, the groove (143) is fixedly disposed with a lower diversion body (17) below the upper diversion body (16), the lower diversion body (17) is disposed with the diversion hole (31), the flow straightener (33) is fixedly disposed in the groove (143) below the lower diversion body (17); the groove bottom of the groove (143) is disposed with the second water diversion port (43);

the cover (15) is disposed with an annular cover, an internal periphery wall (151) extending upwardly from the internal periphery of the annular cover and an external periphery wall (152) extending upwardly from the external periphery of the annular cover, the annular cover is disposed with a second outlet nozzle; the external periphery wall (152) of the cover is fixedly connected to the internal wall of the central hole (12) of the main body (13) in sealing way;

the valve body (14) is fixedly assembly in the central hole (13) of the main body (12), the cylindrical portion (142) is coupled to the internal periphery wall (151), the first section (41) is formed between the external periphery wall (152) and the cylindrical portion (142), the second section (42) is formed between the external periphery wall (152) and the internal periphery wall (151), the suction hole (50) is formed between the cylindrical portion (142) and the internal periphery wall (151).

In another preferred embodiment, the valve body (14) further comprises a transverse plate (145) fixedly connected to the inlet section (141), a water section connected to the second diversion port (43) and the first diversion port (41) is formed between the transverse plate (145) and the end face of the cylindrical portion (142); the transverse plate (145) is disposed with a through hole (146), the switch shaft (21) runs through the through hole (145) in sealing and sliding way.

In another preferred embodiment, the main body (13) is disposed with a throughout hole (131) connected the inner and outer of the central hole (12), one end of the dial button (31) is fixedly connected to the switch shaft (21) from the outer side of the main body (13) through the throughout hole (131).

In another preferred embodiment, the cylindrical portion (142) and the internal periphery wall (151) are arranged with space annularly, the annular space is formed the suction hole (50).

In another preferred embodiment, the lower portion of the cylindrical portion (142) is protruding outwardly with protrusions that are arranged annularly, the end of the protrusion and the external periphery wall are arranged with space.

Compared to the existing known technology, the technical proposal of the present invention has advantages as follows:

1. The suction hole is disposed between the mutation cavity and the second section, on one hand, it uses the diversion waterways to cooperate with the suction hole, so that: when water flows out of the first diversion waterway, air at the outer side enters the mutation cavity from the second diversion waterway through the suction hole, bubble water flows out of the first diversion waterway; when water flows out of the second diversion waterway, air at the outer side enters the second section from the first diversion waterway through the suction hole, the air and water mix in the second diversion waterway, so that water out of the two diversion waterways is bubble water, on the other hand, it doesn't need a suction passage connecting the inner side and the outer side, the structure is compact, it occupies small space.
2. The outlets of the first diversion waterway and the second diversion waterway are disposed at one end of the fixation portion, the second section is annular shaped and surrounds the mutation cavity, the structure is compact, two outlets are at the same end, it has strong applicability.
3. The switch mechanism comprises a switch shaft, a switch sealing ring and a dial button, with the dial button driving the switch shaft to slide up and down, the switch shaft drives the sealing ring to slide up and down so as to switch, the external diameter is small, the structure is compact and it needs small space.

BRIEF DESCRIPTION OF THE DRAWINGS

The present invention will be further described with the drawings and the embodiments.

DETAILED DESCRIPTION OF THE EMBODIMENTS

Figure 1:
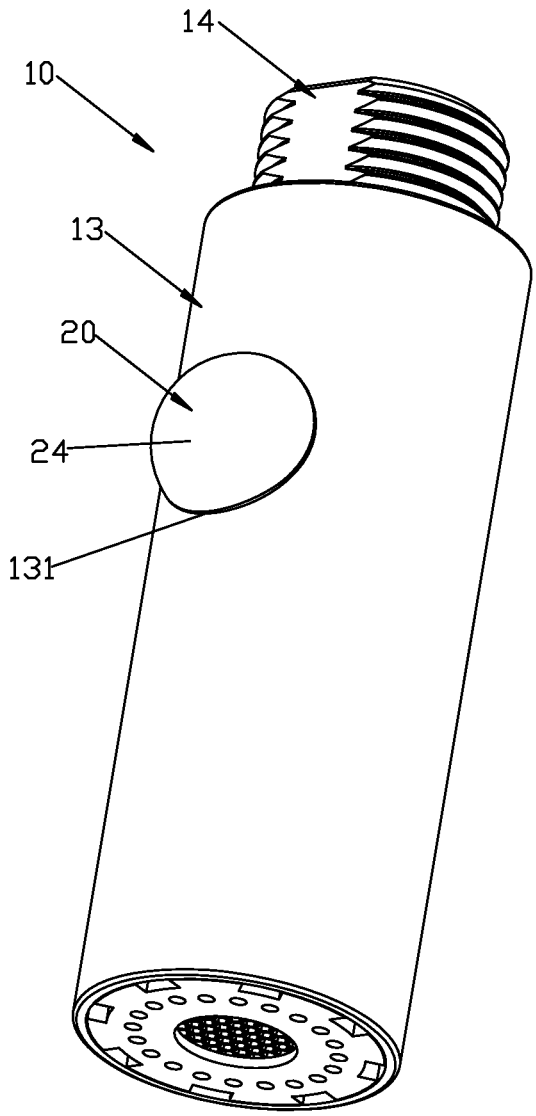
FIG. 1 illustrates a schematic diagram of the shower head.
Figure 2:
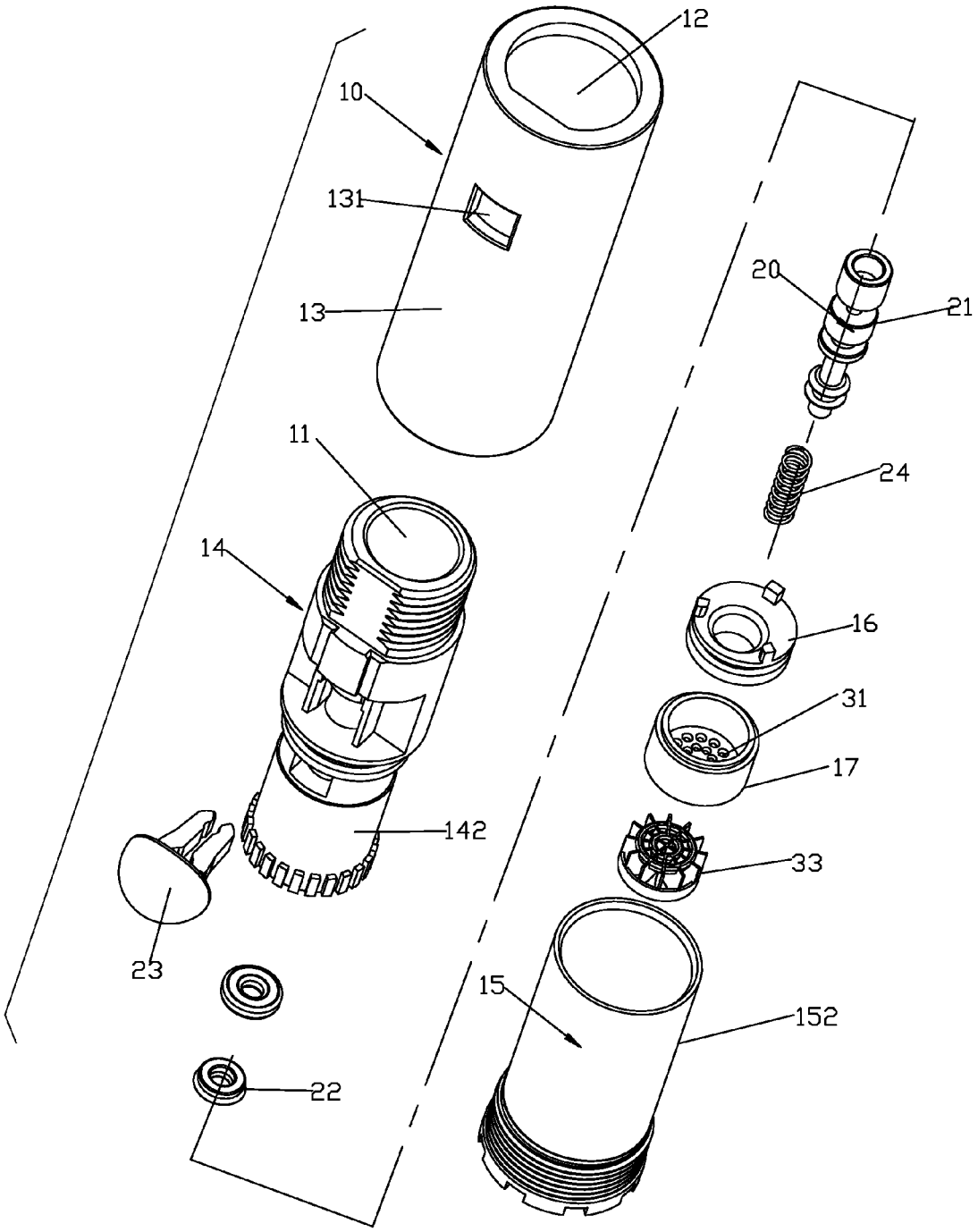
FIG. 2 illustrates an exploded and schematic diagram of the shower head.
Figure 3:
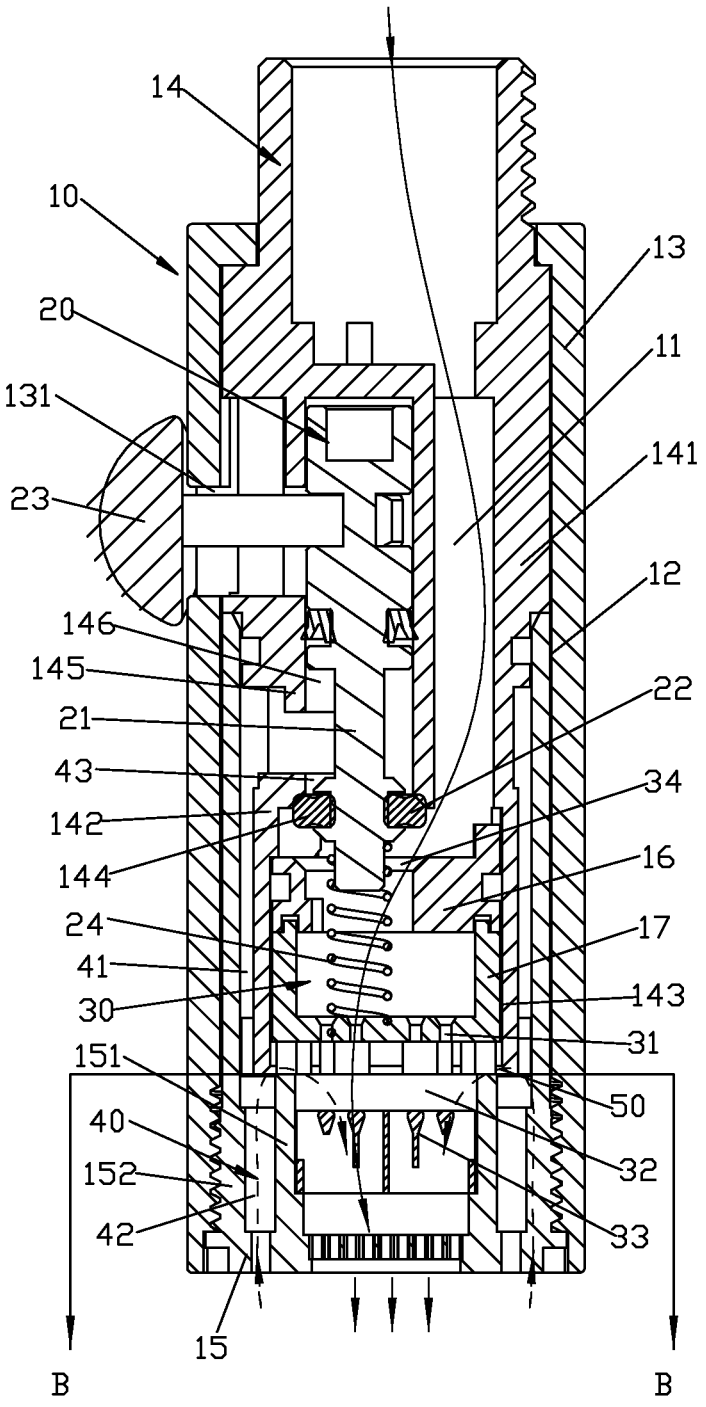
FIG. 3 illustrates a sectional diagram of the shower head in section A-A of FIG. 5 when water flows out of the first diversion waterway.
Figure 4:
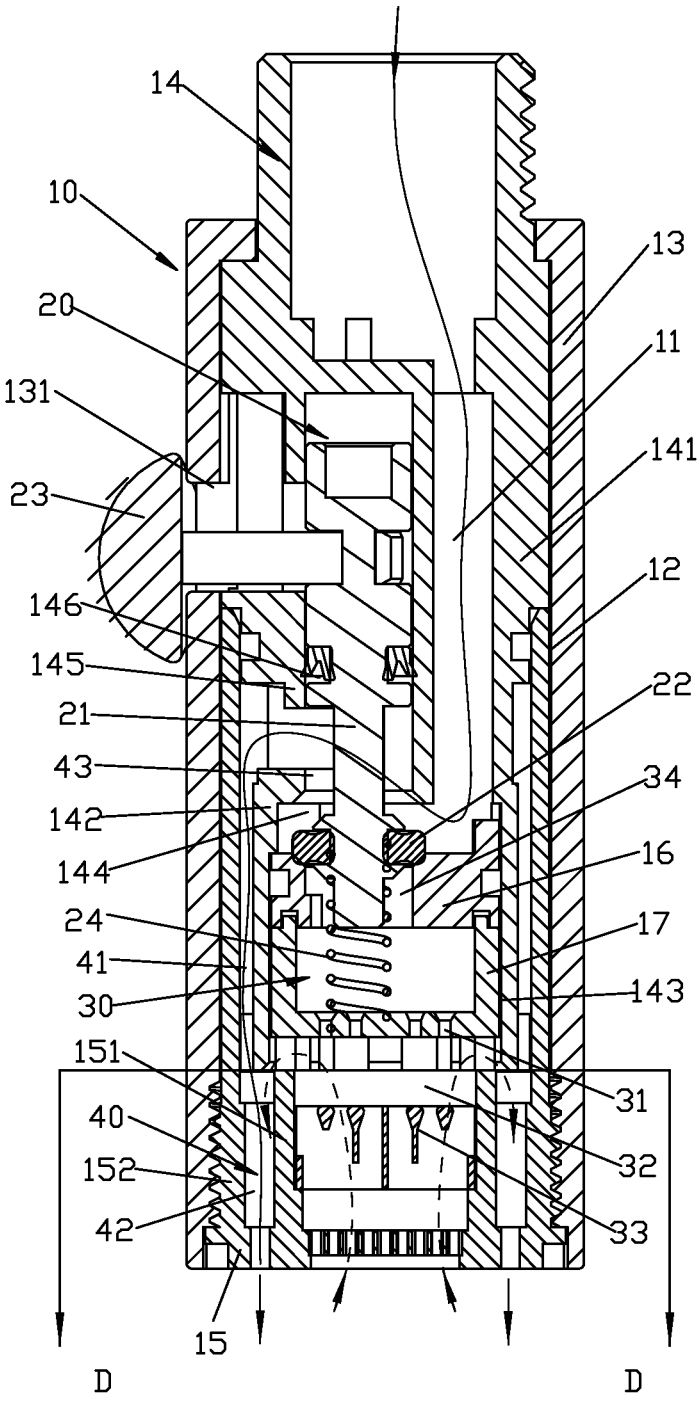
FIG. 4 illustrates a sectional diagram of the shower head in section C-C of FIG. 6 when water flows out of the second diversion waterway.
Figure 5:
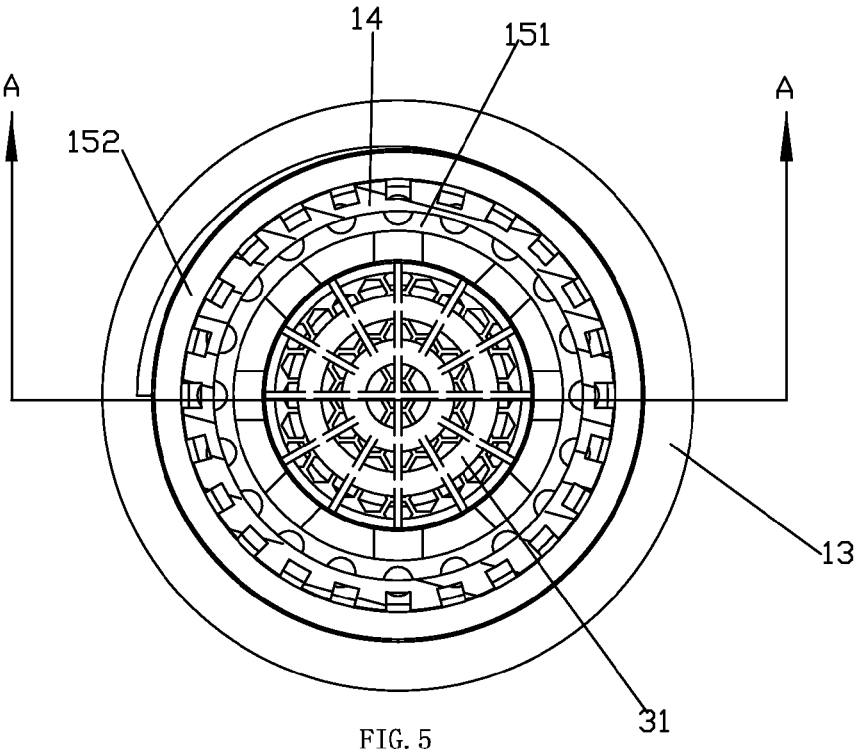
FIG. 5 illustrates a sectional diagram of the shower head in section B-B of FIG. 3 when water flows out of the first diversion waterway.
Figure 6:
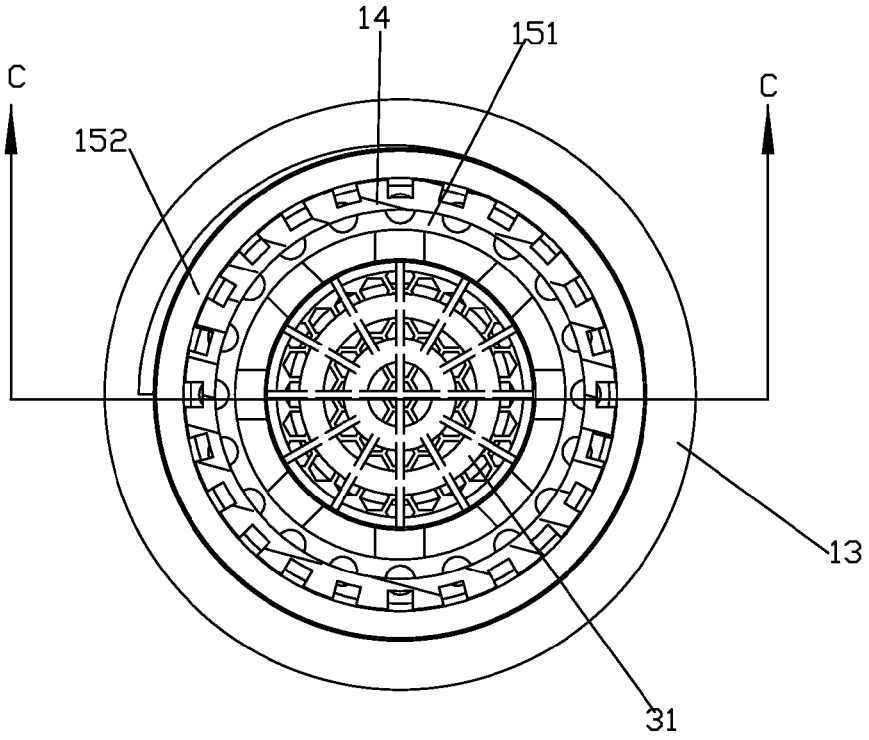
FIG. 6 illustrates a sectional diagram of the shower head in section D-D of FIG. 4 when water flows out of the second diversion waterway.

Please refer to FIGS. 1-6, the shower head comprises a fixation portion 10 and a switch mechanism 20. the fixation portion 10 is disposed with an inlet waterway 11, a first diversion waterway 30 and a second diversion waterway 40, the first diversion waterway 30 and the second diversion waterway 40 are capable of connecting to the inlet waterway 11, the switch mechanism 20 is assembled to the fixation portion 10 to switch the first diversion waterway 30 and the second diversion waterway 40 to connect to the inlet waterway 11. the first diversion waterway 30 comprises at least a diversion hole 31 and a mutation cavity 32 connected to the diversion hole 31, a flow straightener 33 disposed in the mutation cavity 32 is used for the water flowing from the diversion hole 31 to impact therein; the second diversion waterway 40 comprises a first section 41 and a second section 42 connected to the first section 41, the outlet of the first section 41 is smaller than the outlet of the second section 42, so that negative pressure generates in the second section when water flows out of the first section to the second section 42; a suction hole 50 is disposed between the mutation cavity 32 and the second section 42; therein: when water flows out of the first diversion waterway 30, negative pressure generates when water flows from the diversion hole 31 to the mutation cavity 32, air at the outer side enters to the mutation cavity from the second diversion waterway 40 through the suction hole 50, water and air mix, the water flowing breaks when the water flowing impacts the flow straightener 33, so that bubble water flows out of the first diversion waterway 30;

when water flows out of the second diversion waterway 40, negative pressure generates in the second section 42, air at the outer side enters to the second section 42 from the first diversion waterway 30 through the suction hole 50, water and air mix in the second diversion waterway 40.

The first diversion waterway 30 and the second diversion waterway 40 are respectively disposed with a first diversion port 34 and a second diversion port 43 that are arranged vertically symmetrically along the fixation portion 10. the switch mechanism 20 comprises a switch shaft 21, a switch sealing ring 22 sleeved on the switch shaft 21, a dial button 23 and an elastic body 24 disposed between the switch shaft 21 and the fixation portion 10, the switch sealing ring 22 is disposed between the first diversion port 34 and the second diversion port 43. the switch shaft 21 is disposed in the fixation portion 10 in sliding vertically way, one end of the dial button 23 is fixedly connected to the switch shaft 21 from the outer side of the fixation portion 10 into the fixation portion; the switch shaft 21 can drive the switch sealing ring 22 to slide up and down to alternately close the first diversion port 34 or the second diversion port 43, the dial button 23 can slide vertically to drive the switch shaft 21 to slide up and down along the fixation portion 10, the switch shaft 21 drives the switch sealing ring 22 to slide up and down, so that the switch sealing ring 22 closes the first diversion port, the second diversion port is connected to the inlet waterway, alternately, the switch sealing ring 22 closes the second diversion port, the first diversion port is connected to the inlet waterway.

The outlet openings of the first diversion waterway 30 and the second diversion waterway 40 are disposed at one end of the fixation portion, the second section 42 is annular shaped and surrounding the mutation cavity 32.

In detailed, the fixation portion 10 comprises a main body 13, a valve body 14 and a cover 15.

The main body 13 is hollow with a central hole 12, the main body 13 is disposed with a throughout hole 131 connecting the inner and outer of the central hole 12, one end of the dial button 23 is fixedly connected to the switch shaft 21 from the outer of the main body 13 through the throughout hole 131, so that the dial button 23 can slide up and down with respect to the throughout hole 131 so as to drive the switch shaft to slide up and down.

The valve body 14 is disposed with an inlet section 141, a cylindrical portion 142 with the opening facing down and a transverse plate 145 fixedly connected to the inlet section 141, the inlet section 141 is fixedly connected to the top end face of the cylindrical portion 142, the transverse plate 145 and the top end face of the cylindrical portion 142 are arranged with space to form a water section with the opening facing outwardly. The inlet waterway 11 is disposed in the inlet section 141, the cylindrical portion 142 is disposed with a groove 143 with the opening facing down, an upper water diversion body 16 is fixedly disposed in the groove 143 in sealing way, a diversion cavity 144 connected to the inlet waterway 11 is formed between the upper water diversion body 16 and the groove bottom of the groove 143; the upper water diversion body 16 is disposed with the first diversion port 34 throughout vertically, a lower water diversion body 17 is fixedly disposed in the groove 143 below the upper water diversion body 16. The groove bottom of the groove 143 is disposed with above mentioned second diversion port 43, the water section connects the second diversion port 43 and the first section 41. The flow straightener can comprise, for example, a plurality concentric annular ring and radial ribs fixedly connected to the concentric annular rings, the connecting portions of the radial ribs and the annular rings form impact positions, each diversion hole is corresponding to one impact position. The elastic body abuts against between the lower end of the switch shaft and the lower diversion body.

The transverse plate 145 is disposed with a though hole 146, the switch shaft 21 runs through the through hole 145 in sealing and sliding way, the lower end of the switch shaft 21 runts through the second diversion port and then inserts to the water diversion cavity.

The cover 15 is disposed with an annular cover, an internal periphery wall 151 extending upwardly from the internal periphery of the annular cover and an external periphery wall 152 extending upwardly from the external periphery of the annular cover, the annular cover is disposed with a second outlet nozzle; the external periphery wall 152 of the cover is fixedly connected to the internal wall of the central hole 12 of the main body 13 in sealing way.

The valve body 14 is fixedly assembly in the central hole 13 of the main body 12, the cylindrical portion 142 is coupled to the internal periphery wall 151, the first section 41 is formed between the external periphery wall 152 and the cylindrical portion 142, the second section 42 is formed between the external periphery wall 152 and the internal periphery wall 151, preferred, the cylindrical portion 142 and the internal periphery wall 151 are arranged with space annularly, the annular space is formed the suction hole 50.

The lower portion of the cylindrical portion 142 is protruding outwardly with protrusions that are arranged annularly, the end of the protrusion and the external periphery wall are arranged with space, so that the outlet of the first section comprises the through grooves between each two adjacent protrusions and the space between the protrusion and the external periphery wall, the area changes larger when entering the second section.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A shower head, comprising a fixation portion and a switch mechanism, the fixation portion is disposed with an inlet waterway, a first diversion waterway and a second diversion waterway, the first diversion waterway and the second diversion waterway can be connected to the inlet waterway, the switch mechanism is assembled to the fixation portion to switch the first diversion waterway and the second diversion waterway to be connected to the inlet waterway; wherein the first diversion waterway comprises at least a diversion hole and a mutation cavity connected to the diversion hole a flow straightener is disposed in the mutation cavity that water from the diversion hole collides in the flow straightener; the second diversion waterway comprises a first section and a second section connected to the first section, the outlet of the first section is smaller than that of the second section; a suction hole is disposed between the mutation cavity and the second section.

2. The shower head according to claim 1, wherein the outlet openings of the first waterway and the second waterway are disposed at one end of the fixation portion, the second section is annular shaped and surrounding the mutation cavity.

3. The shower head according to claim 2, wherein the first diversion waterway and the second diversion waterway are respectively disposed with a first diversion port and a second diversion port; the switch mechanism comprises a switch shaft, a switch sealing ring sleeved on the switch shaft and a dial button, the switch shaft is disposed in the fixation portion in sliding way, one end of the dial button is inserted to the fixation portion from the outer side of the fixation portion and then fixedly connected to the switch shaft; the switch shaft can drive the switch sealing ring to slide to close the first diversion port and the second diversion port alternatively, the dial button can slide up and down along the fixation portion to drive the switch shaft to slide up and down.

4. The shower head according to claim 3, wherein the first diversion port and the second diversion port are arranged vertically symmetrically along the fixation portion, the switch sealing ring is disposed between the first diversion port and the second diversion port.

5. The shower head according to claim 3, wherein the switch mechanism further comprises an elastic body between the switch shaft and the fixation portion.

6. The shower head according to claim 4, wherein:

the fixation portion comprises a main body with a central hole, a valve body and a cover;

the valve body is disposed with an inlet section and a cylindrical portion with the opening facing down, the inlet waterway is disposed in the inlet section, the cylindrical portion is disposed with a groove with the opening facing down, an upper diversion body is fixedly disposed in the groove in sealing way, a water diversion cavity connected to the inlet waterway is formed between the upper diversion body and the groove bottom of the groove; the upper diversion body is disposed with a first water diversion port running through the upper diversion body up and down, the groove is fixedly disposed with a lower diversion body below the upper diversion body, the lower diversion body is disposed with the diversion hole, the flow straightener is fixedly disposed in the groove below the lower diversion body; the groove bottom of the groove is disposed with the second water diversion port;

the cover is disposed with an annular cover, an internal periphery wall extending upwardly from the internal periphery of the annular cover and an external periphery wall extending upwardly from the external periphery of the annular cover, the annular cover is disposed with a second outlet nozzle; the external periphery wall of the cover is fixedly connected to the internal wall of the central hole of the main body in sealing way;

the valve body is fixedly assembly in the central hole of the main body, the cylindrical portion is coupled to the internal periphery wall, the first section is formed between the external periphery wall and the cylindrical portion, the second section is formed between the external periphery wall and the internal periphery wall, the suction hole is formed between the cylindrical portion and the internal periphery wall.

7. The shower head according to claim 6, wherein the valve body further comprises a transverse plate fixedly connected to the inlet section, a water section connected to the second diversion port and the first diversion port is formed between the transverse plate and the end face of the cylindrical portion; the transverse plate is disposed with a through hole, the switch shaft runs through the through hole in sealing and sliding way.

8. The shower head according to claim 6, wherein the main body is disposed with a throughout hole connected the inner and outer of the central hole, one end of the dial button is fixedly connected to the switch shaft from the outer side of the main body through the throughout hole.

9. The shower head according to claim 6, wherein the cylindrical portion and the internal periphery wall are arranged with space annularly, the annular space is formed the suction hole.

10. The shower head according to claim 6, wherein the lower portion of the cylindrical portion is protruding outwardly with protrusions that are arranged annularly, the end of the protrusion and the external periphery wall are arranged with space.

* * * * *